US006839438B1

(12) United States Patent
Riegelsberger et al.

(10) Patent No.: US 6,839,438 B1
(45) Date of Patent: Jan. 4, 2005

(54) POSITIONAL AUDIO RENDERING

(75) Inventors: Edward Riegelsberger, Fremont, CA (US); Martin Walsh, Palo Alto, CA (US)

(73) Assignee: Creative Technology, Ltd, Singapore (SG)

( * ) Notice: Subject to any disclaimer, the term of this patent is extended or adjusted under 35 U.S.C. 154(b) by 536 days.

(21) Appl. No.: 09/630,439

(22) Filed: Aug. 2, 2000

Related U.S. Application Data

(60) Provisional application No. 60/152,152, filed on Aug. 31, 1999.

(51) Int. Cl.[7] ..... H04R 5/00
(52) U.S. Cl. ..... 381/18; 381/303
(58) Field of Search ..... 381/18, 17, 303, 381/1

(56) References Cited

U.S. PATENT DOCUMENTS

| | | | | |
|---|---|---|---|---|
| 3,236,949 | A | 2/1966 | Atal et al. | |
| 4,975,954 | A | 12/1990 | Cooper et al. | |
| 5,034,983 | A | 7/1991 | Cooper et al. | |
| 5,136,651 | A | 8/1992 | Cooper et al. | |
| 6,577,736 | B1 * | 6/2003 | Clemow | 381/18 |

OTHER PUBLICATIONS

Product Information Brochure for "Sensaura".

* cited by examiner

*Primary Examiner*—Minsun Oh Harvey
(74) *Attorney, Agent, or Firm*—Van Pelt & Yi LLP

(57) ABSTRACT

An audio rendering system and method are disclosed. The audio rendering system generally comprises front and rear signal modifiers configured to receive a plurality of audio signals representing a plurality of sources of aural information and location information representing apparent location for the source of said aural information. A gain is applied to the signals representative of the location information. A front signal modifier includes a plurality of head-related transfer functions filters and a rear signal modifier includes a plurality of filters configured to approximate head-related transfer function filters. The system further includes front speakers comprising a left front speaker and right front speaker configured to receive signals from the front signal modifier and generate a signal to a listener. At least one rear speaker is configured to receive signals from the rear signal modifier and generate a signal to the listener to offset frontward bias created by the front speakers. The gains applied to the signal are calculated to produce generally equal perceived energy from each of the front and rear speakers.

9 Claims, 6 Drawing Sheets

POSITIONAL AUDIO RENDERING

RELATED APPLICATION

The present application claims the benefit of U.S. Provisional Application Ser. No. 60/152,152, filed August 31, 1999.

BACKGROUND OF THE INVENTION

The present invention relates generally to acoustic modeling, and more particularly, to a system and method for rendering an acoustic environment using more than two speakers.

Positional three-dimensional audio algorithms produce the illusion of sound emanating from a source at an arbitrary point in space by calculating the acoustic waveform which would actually impinge upon a listener's eardrums from the source. Systems have been developed to simulate a virtual sound source in an arbitrary perceptual location relative to a listener. These virtual acoustic displays apply separate left ear and right ear filters to a source signal in order to mimic the acoustic effects of the human head, torso, and pinnae on source signals arriving from a particular point in space. These filters are referred to as head related transfer functions (HRTFs). HRTFs are functions of position and frequency which are different for different individuals. When a sound signal is passed through a filter which implements the HRTF for a given position, the sound appears to the listener to have originated from that position.

Many applications comprise acoustic displays utilizing one or more HRTF filters in attempting to spatialize or create a realistic three-dimensional aural impression. Acoustic displays can spatialize a sound by modeling the attenuation and delay of acoustic signals received at each ear as a function of frequency, and apparent direction relative to head orientation. U.S. patent application Ser. Nos. 5,729,612 and 5,802,180, which are incorporated herein by reference, provide examples of implementation of a virtual audio display using HRTFs.

Stereo audio streams in which the left and right channels are developed independently for the left and right ears of a listener are referred to as binaural signals. Headphones are typically used to send binaural signals directly to a listener's left and right ears. The main reason for using headphones is that the sound signal from the speaker on one side of the listener's head generally does not travel around the listener's head to reach the ear on the opposite side. Therefore, the application of the signal by one headphone speaker to one of the listener's ears does not interfere with the signal being applied to the listener's other ear by the other headphone speaker through an external path. Headphones are thus an effective way of transmitting a binaural signal to a listener, however, it is not always convenient to wear headphones or earphones.

Complications arise in systems which do not deliver the audio signal directly to the listener's ear. If a binaural signal is used to drive free standing speakers directly, then the listener will hear contributions from each speaker at each ear. The receipt of the signal intended for the right ear at the left ear and vice versa is referred to as "cross-talk". It is necessary in such systems to compensate for or to cancel somehow the cross-talk so that the desired binaural signal is effectively applied to each of the listener's ears. The speaker cross-talk canceller does this by eliminating the positional cues related to speaker position and removing the interference of each speaker on the other.

A conventional implementation of a positional three-dimensional audio system includes a head-related transfer function (HRTF) processor followed by a speaker cross-talk cancellation algorithm. As previously described, the HRTF processor simulates the interaction of sound waves with the listener's head, ears, and body to reproduce the natural cues that would be heard from a real source in the same position. An impression that an acoustic signal originates from a particular relative direction can be created in a binaural display by applying an appropriate HRTF to the acoustic signal, generating one signal for presentation to the left ear and a second signal for presentation to the right ear, each signal changed in a manner which results in the perceived signal that would have been received at each ear had the signal actually originated from the desired relative direction.

SUMMARY OF THE INVENTION

An audio rendering system and method are disclosed. The audio rendering system generally comprises front and rear signal modifiers configured to receive a plurality of audio signals representing a plurality of sources of aural information and location information representing apparent location for the source of said aural information. A gain is applied to the signals representative of the location information. A front signal modifier includes a plurality of head-related transfer functions filters and a rear signal modifier includes a plurality of filters configured to approximate head-related transfer function filters. The system further includes front speakers comprising a left front speaker and right front speaker configured to receive signals from the front signal modifier and generate a signal to a listener. At least one rear speaker is configured to receive signals from the rear signal modifier and generate a signal to the listener to offset frontward bias created by the front speakers. The gains applied to the signal are calculated to produce generally equal perceived energy from each of the front and rear speakers.

A method for providing a two channel signal to the ears of a listener through an audio system including a plurality of audio signals which are played through two front speakers and at least one rear speaker generally comprises receiving a plurality of audio signals representing a plurality of sound sources and applying a head-related transfer function to each signal representative of a location of each of the sound sources. A front gain is applied to the signals to create front signals and the front signals are sent to the two front speakers. A rear gain is applied to the signals to create rear signals which are sent to the rear speaker. The gains applied to the signals are calculated to produce generally equal perceived energy from each of the front and rear speakers.

The above is a brief description of some deficiencies in the prior art and advantages of the present invention. Other features, advantages, and embodiments of the invention will be apparent to those skilled in the art from the following description, drawings, and claims.

BRIEF DESCRIPTION OF THE DRAWINGS

Corresponding reference characters indicate corresponding parts throughout the several views of the drawings.

DETAILED DESCRIPTION OF THE INVENTION

Figure 1:
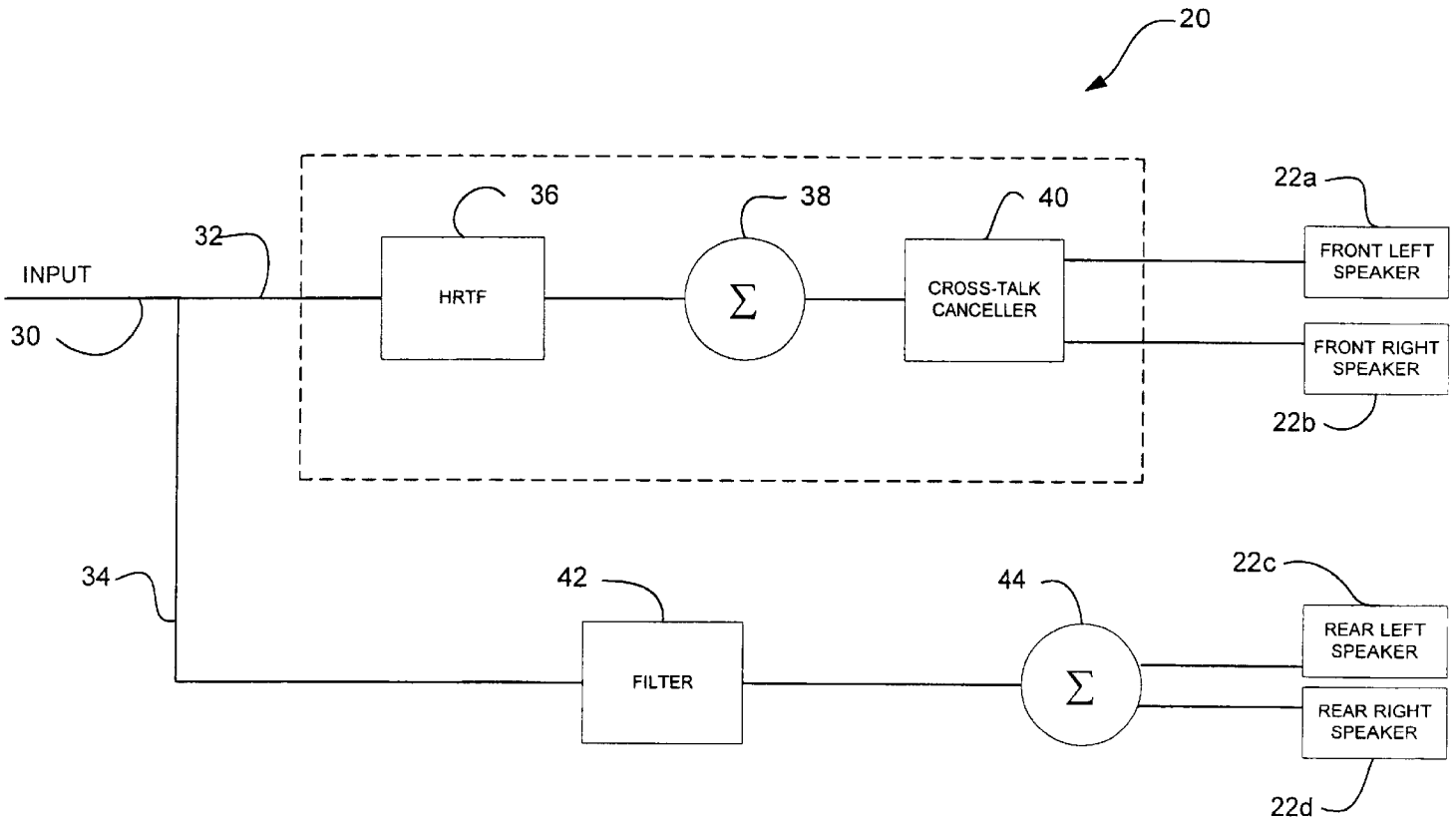
FIG. 1 is a block diagram illustrating an electronic configuration of an audio rendering system according to a first embodiment of the present invention.
Figure 2:
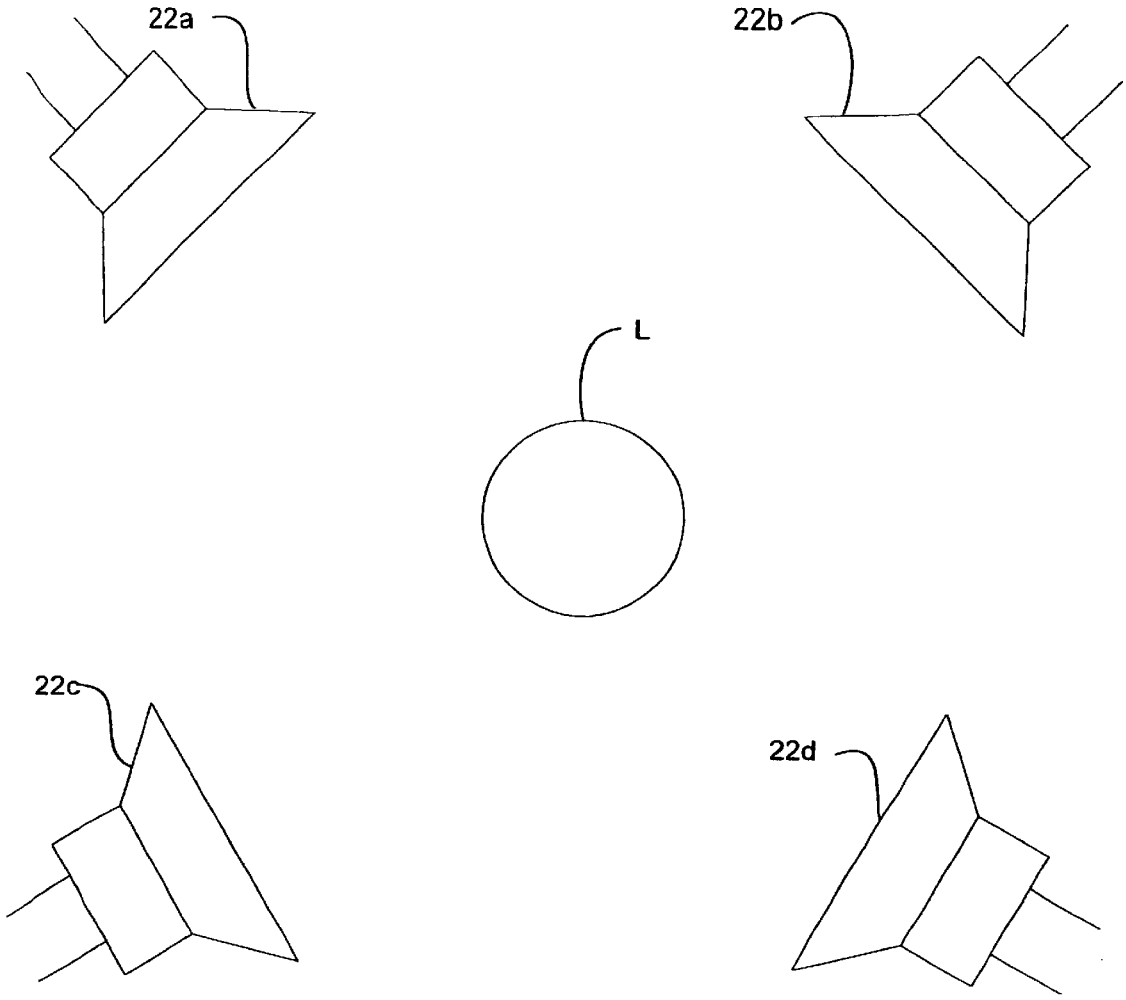
FIG. 2 is a plan view illustrating a positional relationship between speakers and a listener.
Figure 3:
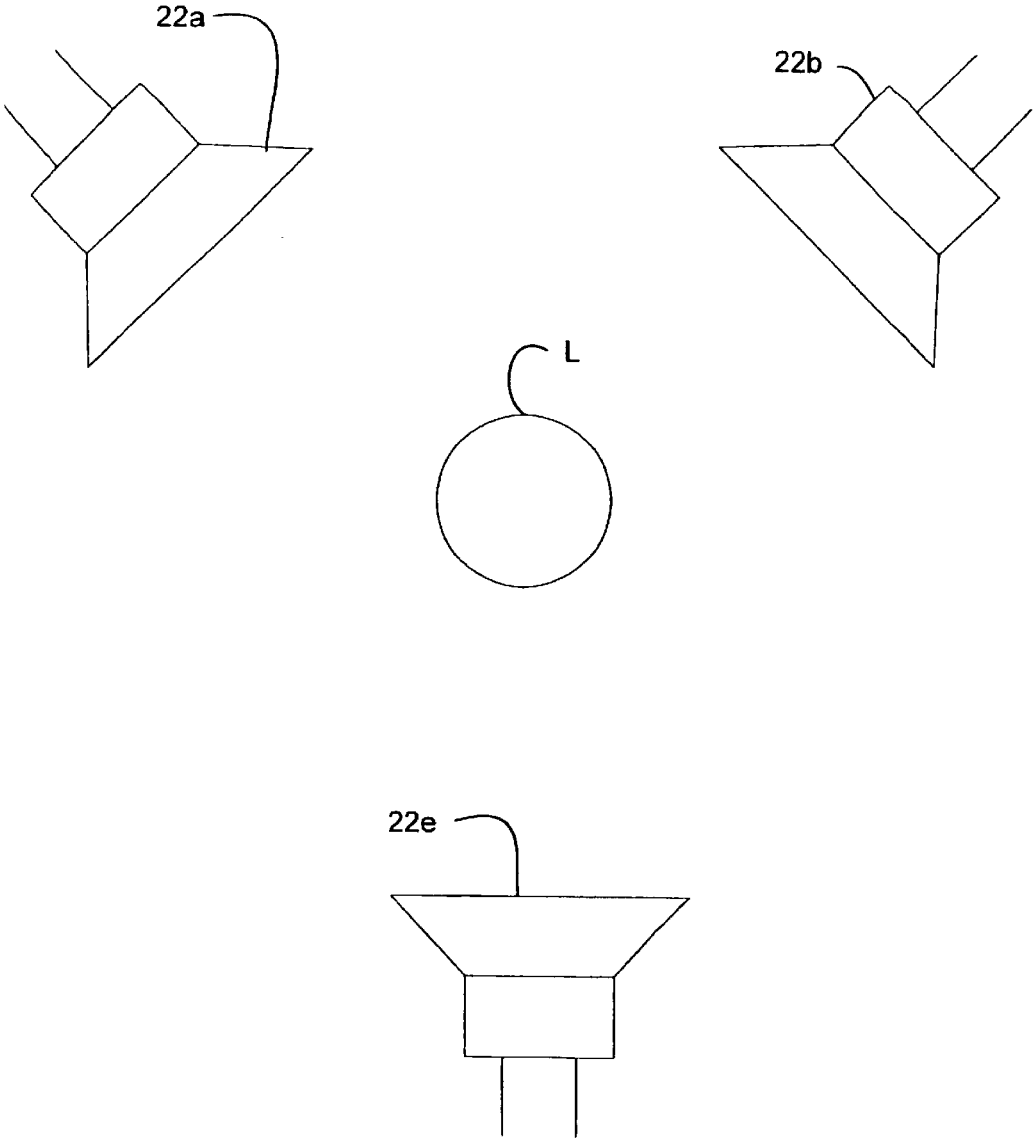
FIG. 3 is a plan view illustrating an alternative arrangement of speakers.

Referring now to the drawings, and first to FIG. 1, an audio rendering system is generally indicated at 20. The audio rendering system includes three or more speakers positioned generally surrounding a listener L, as shown in FIGS. 2 and 3. The speakers are positioned so that a left side speaker 22*a* and right side speaker 22*b* are located in front of a listener, and either a left speaker 22*c* and right speaker 22*d* are located behind the listener (FIG. 2), or one speaker 22*e* is located behind the listener (FIG. 3). The rear speakers are provided to reduce positional ambiguity due to model-mismatch in the reception of three-dimensional audio over the front speakers while still retaining the full three-dimensional positional cues provided by HRTF processing. The sound provided from the rear speakers reduces or eliminates frontward bias which is present in conventional two speakers system. As further described below, front and rear gains are adjusted as the source location is changed to produce equal perceived energy contributions from all four speakers. Thus, the perceived energy of the source is relatively independent of direction.

It is to be understood that the number and arrangement of speakers may be different than shown herein without departing from the scope of the invention. For example, although a symmetric speaker system is shown, the present invention includes any arbitrary arrangement of speakers so long as the transfer functions used to position each source account for differences in speaker position relative to the listener. Referring again to FIG. 1, a plurality of waveform signals (e.g., sixteen mono signals from one or more sound sources) are input to channels (e.g., sixteen) of the audio rendering system at 30 (FIG. 1). The audio signals represent a plurality of sources of aural information and location information for each signal. The location information identifies apparent locations for the sources of the aural information. The signals are sent along a first branch 32 for processing to generate signals for the front left and front right speakers 22*a*, 22*b*, and along a second branch 34 for processing to generate signals for the rear left and rear right speakers 22*c*, 22*d*.

The signals travelling along the first branch 32 are input to a plurality of filters 36. In order to simplify the illustration and description of the system, only one filter 36 is shown in FIG. 1. Also, the branches 32, 34 and paths between components are shown as single lines, however, these lines may represent one signal or a plurality of signals. The filter 36 may be an HRTF filter or any other type of headphone three dimensional rendering filter, as is well known by those skilled in the art. The filter 36 preferably converts the mono signal to a stereo pair. For example, there may be sixteen filters 36 which convert sixteen mono signals to sixteen stereo pairs (thirty-two signals). The filter 36 preferably provides spectral shaping and attenuation of the sound wave to account for differences in amplitude and time of arrival of sound waves at the left and right ears. The signals are then sent from the filters 36 to a mixer/scaler 38 which sums all of the signals (e.g., thirty-two signals from the sixteen filters 36) to produce a stereo output (one front left speaker signal and one front right speaker signal). The mixer/scaler 38 adjusts a front gain of the front speakers based on the position of the sound source. The sum is a weighted sum, with each weight depending on the corresponding source position. The front and rear gains may be applied in the filter 36, mixer/scaler 38, or combined in both the filter and mixer/scaler.

The left and right speaker signals are preferably sent from the mixer/scaler 38 to a cross-talk canceller 40. The cross-talk canceller 40 is designed to cancel cross-talk sounds which emerge when a person hears binaural sounds over two speakers. It is designed to eliminate the cross-talk phenomenon in which the right side sound enters the left ear and the left side sound enters the right ear. The cross-talk canceller 40 may be one as described in U.S. patent application Ser. No. 09/305,789, by Gerrard et al., filed May 4, 1999, for example. Under operation of the cross-talk canceller 40, the outputs arc converted into the sounds which, when heard over speakers in a specified position, are roughly heard by the left ear only from the left-side speaker and sounds which are roughly heard by the right ear only from the right side speaker. Such sound allocation roughly simulates the situation in which the listener hears the sounds by use of a headphone set.

The filter 36, mixer/scaler 38, and cross-talk canceller 40 may all be provided on a single chip as indicated by the dotted line shown in FIG. 1, for example. The components included in path 34 and described below may similarly be provided on a single chip.

The signals sent along path 34 are input to a plurality of filters 42 (only one shown) which add spectral coloring to the signals to smooth out the signals and approximately match the HRTF filtering. The filter 42 receives a mono input and produces a plurality of outputs equal to the number of rear speakers (e.g., two). The filters 42 are position dependent, as described above for the filters 36. The filter 42 may be the same as the HRTF filters 36 used for the front speakers or some approximation of the HRTF filters. Preferably, the filter 42 does not provide all of the processing included in the HRTF filter 36 to reduce system complexity. The filter 42 frequency characteristics are preferably designed to minimize tibral differences or mismatch between the front and rear speakers and help to provide for smooth transitions from the front speakers to the rear speakers. Since the filters 36, 42 change as the source changes position, the system is preferably designed to provide a form of smooth transitioning between the filters (e.g., tracking).

For two rear speakers, one simple approximation to HRTF filtering is panning. If an HRTF filter is not used in the rear sound processing, panning is preferably provided between the rear left speaker signal and the rear right speaker signal. The panning represents a certain source position which is located between two speakers. By varying the gain value between 0 and 1, it is possible to change the sound-image position corresponding to the sound produced responsive to the sound effect signal between two speakers. When the gain value is equal to zero, the sound signal is provided so that the sound image position is fixed at the position of one of the speakers 22*c*, 22*d*. When the gain value is at 1, the sound image position is fixed at a position directly above the speakers 22*c*, 22*d*. When the gain value is set at a point between 0 and 1, the sound image is positioned between the speakers 22*c*, 22*d*. The gain value for panning is preferably applied at the filters 42.

The signals are converted in the filters 42 from mono to two channels and sent to a mixer/scaler 44, as described above for the front speaker signals. The mixer/scaler 44 sums signals (e.g., thirty-two signals) to form a stereo pair (one signal for rear left speaker 22*c* and one signal for rear right speaker 22*d*). The sum is preferably a weighted sum, with each weight dependent on the corresponding source position. As previously described, each channel has its own gain and the mixer/scaler 44 adjusts the rear gain based on the position of the sound source. If only one rear speaker 22*e* is used, as shown in FIG. 3, the mixer 44 will sum all the signals to form a single signal.

Figure 4:
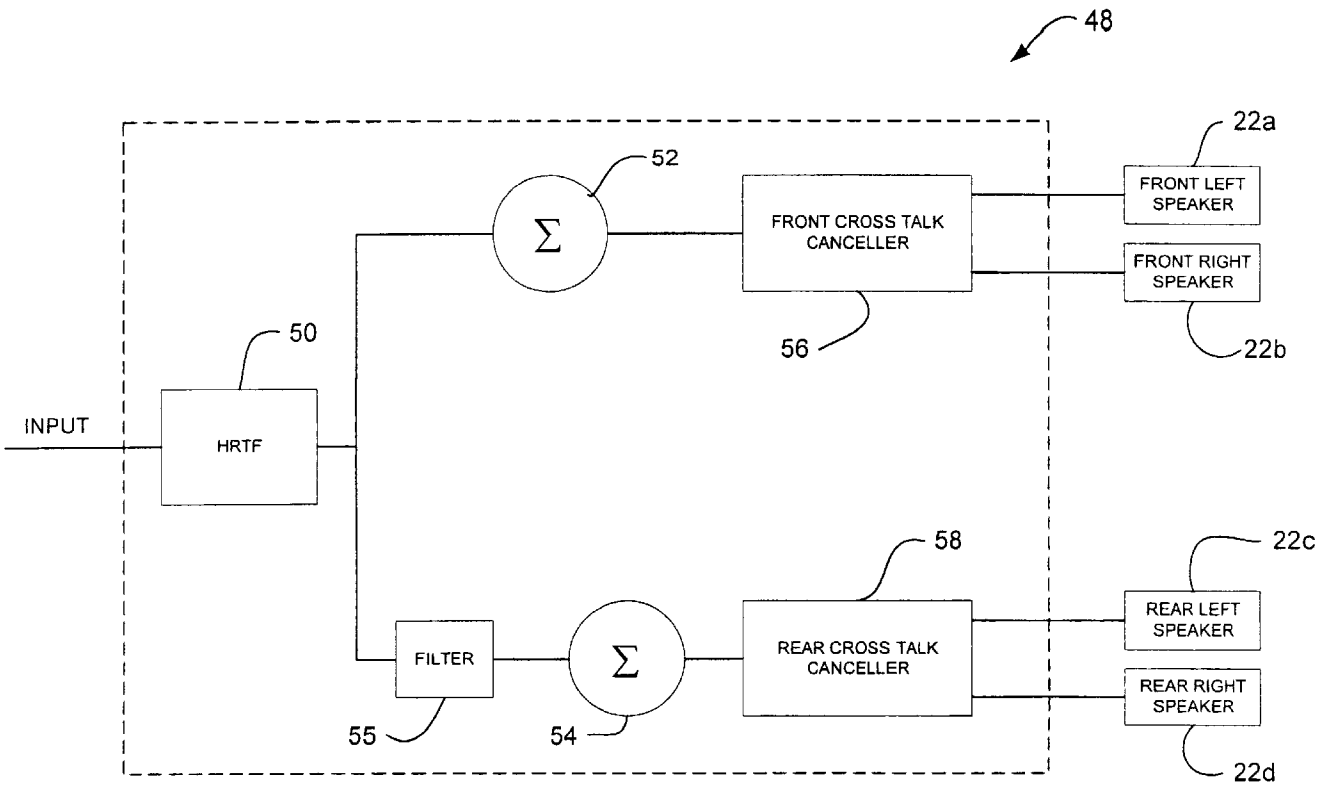
FIG. 4 is a block diagram illustrating a second embodiment of the audio rendering system of FIG. 1.

FIG. 4 shows a second embodiment, generally indicated at 48, of an audio rendering system. The system 48 includes a plurality of HRTF filters 50 (only one shown), a plurality of rear panning filters 55 (only one shown), two mixer/scalers 52, 54, two cross-talk cancellers 56, 58, and the front left speaker 22*a*, front right speaker 22*b*, rear left speaker 22*c*, and rear right speaker 22*d*. The HRTF filters 50 receive a plurality of signals (e.g., sixteen) from a sound generator. The signals are converted from mono to stereo by the HRTF filters 50 and processed as previously described. The front signals are then sent to the front mixer/scaler 52. The rear signals are first sent to the filters 55 which apply a gain to provide panning between the left and right rear speakers. The rear signals are then sent to the rear mixer/scaler 54. Since common HRTF filters 50 are used for both the front and rear signals, the front and rear gains which are derived based on position of the source are applied at the mixer/scalers 52, 54 instead of the HRTF filter. This allows different gains to be applied to the signals for the front speakers 22*a*, 22*b* and rear speakers 22*c*, 22*d*. The system 48 may also be configured without the rear cross-talk canceller 58. By removing the rear cross-talk canceller, there will be no need to line up sweet spots for both the front and rear cross-talk cancellers. Thus, with only a front cross-talk canceller, the sweet spot region for the listener will be larger. The HRTF filter 50, mixer/scalers 52, 54, and cross-talk cancellers 56, 58, may all be included on a single chip as indicated by the dotted lines shown in FIG. 4, for example.

It is to be understood that the configuration of components within the system and arrangement of the components may be different than those shown and described herein without departing from the scope of the invention.

Figure 5:
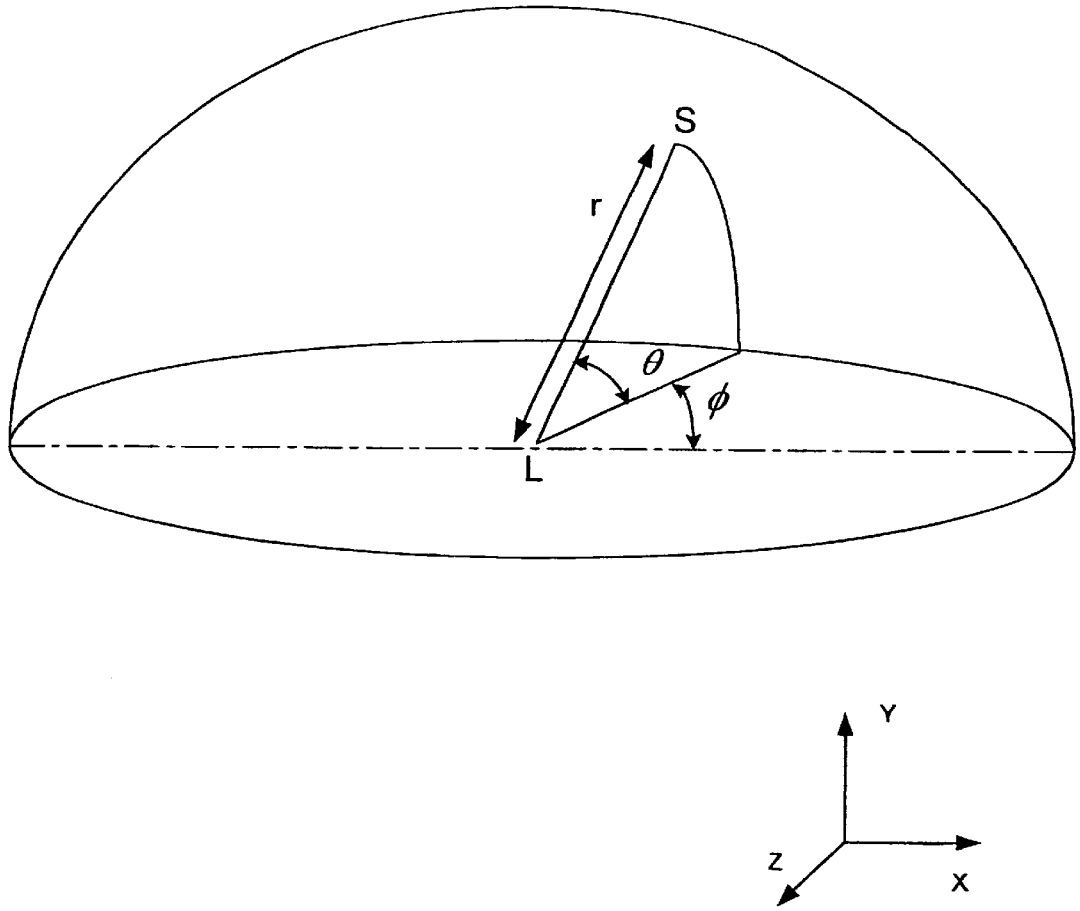
FIG. 5 is a schematic illustrating a polar coordinate system used to define a three-dimensional space.
Figure 6:
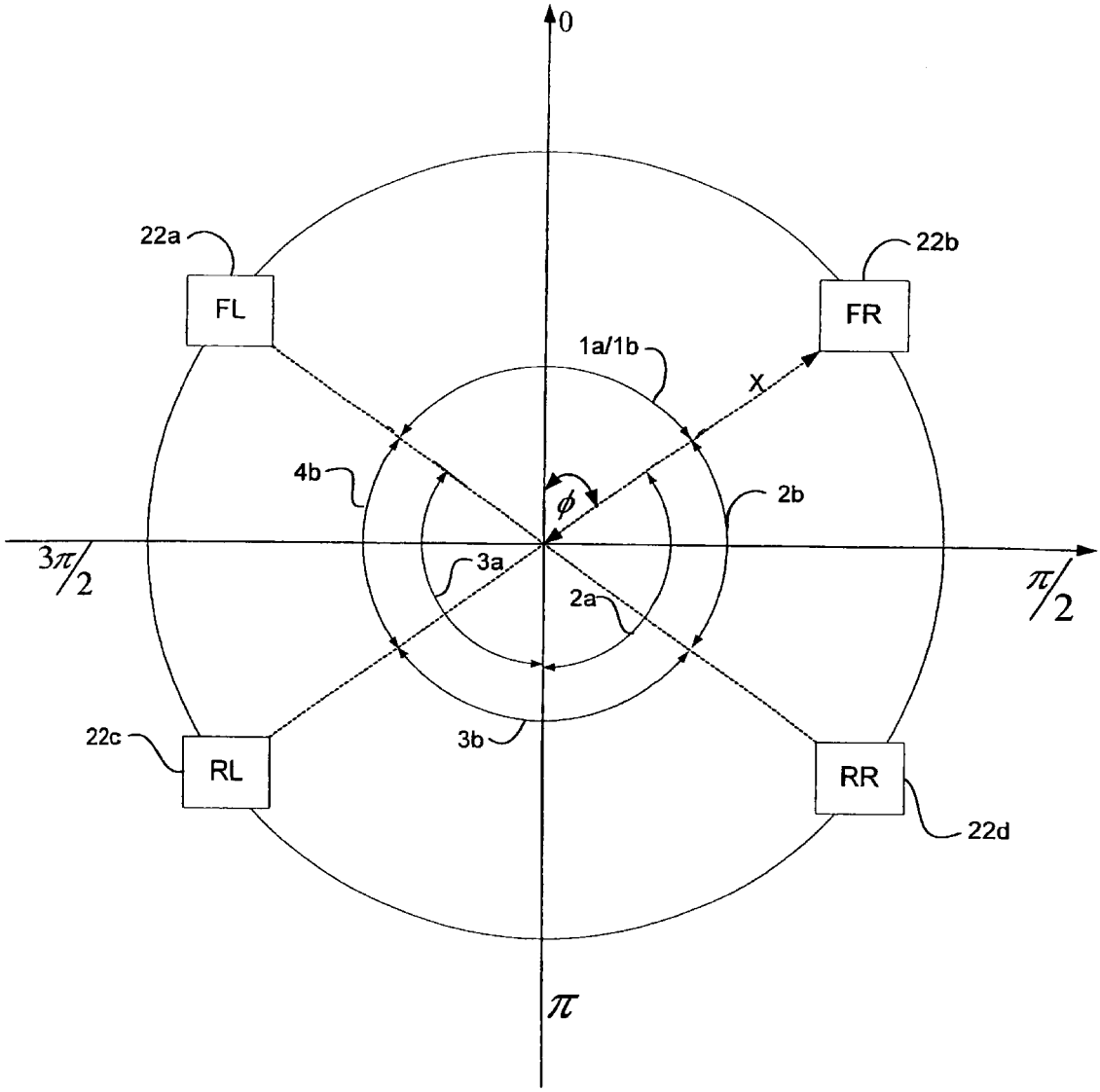
FIG. 6 is a plan view of the polar coordinate system of FIG. 5 illustrating positions of speakers relative to a listener.

In order to calculate weights for the mixer scalers 38, 44, 52, 54, location information is provided to identify the position of each sound source in a spherical coordinate system defined for the listening environment. The coordinate system of a three dimensional listening space is defined with respect to the illustration of FIGS. 5 and 6. The origin of the coordinate system is at the location of a listener L at ear level and the source of the signal is produced from point S. In FIG. 5, r designates a distance between the listener L and the sound source S; phi ($\phi$) identifies an azimuth angle with respect to a horizontal axis (i.e., x-axis as shown in FIG. 5) containing the origin (i.e., location of listener L); and theta ($\theta$) identifies an elevation angle with respect to the horizontal plane (i.e., x-z plane in FIG. 5) containing the listener. Positive azimuth angles $\phi$ are to the right of the listener L and positive elevation angles $\theta$ are above the listener. The front direction is therefore defined as $\phi=0$; the left side direction is defined by $\phi<0$; the right side direction is defined by $\phi>0$; and $\theta>\theta 0$ is above the listener L. As shown in FIG. 6, the front left and right speakers 22*a*, 22*b* are positioned at $\phi=\pi/4$ and $+\pi/4$, respectively, $\theta=0$, and distance=x. The rear left and right speakers 22*c*, 22*d* are positioned at $\phi=-3\pi/4$ and $+3\pi/4$, respectively, $\theta=0$, and distance=x.

Front and rear gains for sources located at the ear level horizontal plane (elevation angle of 0) depend on which sector the source is located. A sector is defined as the region between two speakers relative to the listener. When the virtual source is located in the sector defined by the front two speakers (region 1*b*), operation is the same as with a two-speaker system. Front gain is one and rear gain is zero. When the virtual source is located between the rear two speakers (3*b*), the front gain is zero (or close to zero) and the rear gain is one. When the virtual source is located between one of the side speaker pairs (2*b*, 4*b*), the front gains are proportional to the fraction of the arc between the front and rear speaker spanned by the virtual source. The front gain varies from one to zero (or close to zero) as the virtual source azimuth angle $\phi$ moves from the front speakers 22*a*, 22*b* to the rear speakers 22*c*, 22*d*. Rear gains vary similarly, except that they vary from zero to one over the same range of source azimuth angles $\phi$.

Sources located off the horizontal plane of the ears behave similarly, but with some adjustments that aid the perception of elevation. For elevation angles of plus or minus 90 degrees (i.e., directly above or below the listener), front and rear gains are adjusted to produce equal perceived energy contributions from all four speakers. As elevation angle varies from zero degrees to plus or minus 90 degrees, the front and rear gains vary smoothly from the horizontal plane case to the plus or minus 90 degrees case, maintaining a constant perceived power level (e.g., source trajectories maintain the same distance from the listener).

The following provides an example of a method for calculating front gains and rear gains based on the position of the sound source relative to the listener. In the following calculations, the front speakers 22*a*, 22*b* are located at $\pm\pi/4$ and the rear speakers are positioned at $\pm 3\pi/4$ (FIG. 6).

When the source is located within the region defined by at $\pm\pi/4$ (i.e., location between front left and right speakers) sound is generated only from the front speakers. If the sound moves rearward from these points it contributes to the rear gain. The point at which sound is first applied at the rear speakers (e.g., $\pi/4$) is called the rear pan start angle. In the following equations, the rear pan start angle is defined as $\pi/4$ and the rear speaker angle is defined as $3\pi/4$. It is to be understood that the rear pan start angle may be different than the location of one of the front speakers.

The following provides an example of calculations for the front gain (Front Gain) and rear gain (Rear Gain) (for front to rear panning) and the left and right rear speaker gains (Left Rear Gain, Right Rear Gain) (for left to right panning). The front gain is preferably applied at the mixer/scalers 38, 52 of FIGS. 1 and 4, respectively. The rear gain is preferably applied at the mixer/scalers 44, 54 of FIGS. 1 and 4, respectively. The left and right rear gains provide panning between the rear speakers and are applied at filters 42, 55, of FIGS. 1 and 4, respectively.

In calculating the front gain for the front speakers 22*a*, 22*b*, the speakers are attenuated equally depending on the source location. At elevation ($\theta$)=0, gain is only a function of $\phi$. At elevation ($\theta$)=$\pm\pi/2$, gain is independent of azimuth angle ($\phi$). At elevations between 0 and $\pi/2$, the gain varies smoothly between the elevation=±90 gain and the elevation=0 gain for the given azimuth value. The front gain, when elevation is equal to zero, is calculated based on the azimuth angle of the virtual source. The first sector 1*a* is defined as a region between the front two speakers 22*a*, 22*b* (i.e., rear pan start angle $>\phi\geqq 2\pi$—rear pan start angle). The front attenuation of the front speakers (Front Atten) in sector la is equal to one.

The second sector 2*a* is defined as a region between the right front speaker 22*b* and $\pi$ (i.e., $\pi>\phi\geqq$ rear pan start angle). For sector 2*a*, front attenuation is defined as max(cos 1.2 * $\Omega_1$,0) where:

$\Omega_1$=0.5 π* (φ—rear pan start angle)/(π—rear pan start angle).

The third sector 3*a* includes the region between the left front speaker 22*a* and π (i.e., 2π—rear pan start angle >φ≧π). The front attenuation is defined as max(cos 1.2* $\Omega_2$,0) where:

Ω2=0.5 π* (2 π—rear pan start angle—φ)/(2 π—rear pan start angle—π)

The contribution from elevation is calculated as

Front θ= absolute value $(2*\theta/\pi)^{1.5}$.

The front gain is then calculated as:

Front Gain=Front Atten* (1—Front θ)+sqrt (2.0)/2.0;

The rear gain is calculated to produce equal perceived energy contributions from all the speakers while maintaining the same ratio of left to right rear volume. At θ=0, gains are purely a function of azimuth angle φ. At θ=±90, gains are independent of azimuth angle φ. For elevations between these extremes, the gains vary smoothly between the elevation =±90 gain and the elevation=0 gain for the given azimuth value. For any source position, the perceived energy coming from all four speakers preferably equals the perceived energy produced by the front speakers when the front gain is equal to one. Thus, when the front gain is less then one, the rear gain is scaled such that the perceived energy remains constant. The rear gain applied by the mixer/scalers 42, 54 is thus calculated so that the perceived energy coming from all four speakers is generally constant:

Front $\text{Gain}^2$+Rear $\text{Gain}^2$=1

Front Power=Front $\text{Gain}^2$ $$\text{Rear Gain} = \sqrt{1 - FrontPower}$$

The following describes calculations used to determine the left and right rear gains applied at the filters 42, 55. The listening environment shown in FIG. 6 is broken into four sectors; 1*b*, 2*b*, 3*b*, and 4*b*.

If the source is between the front left and right speakers 22*a*, 22*b* in sector 1*b* (i.e., rear pan start angle >φ≧2π—rear pan start angle) and φ≧0 then:

$\Omega_3$=0.5 π* (φ+rear pan start angle)/(2* rear pan start angle);

if φ<0 then:

$\Omega_3$=0.5 π* (φ—(2π—rear pan start angle ))/(2* rear pan start angle). The rear speaker attenuation is then calculated as:

Left Rear Atten=cos $\Omega_3$

Right Rear Atten=sin $\Omega_3$.

If the source is between the front right and rear right speakers 22*b*, 22*d* in sector 2*b* (i.e., rear speaker angle >φ≧ rear pan start angle):

Left Rear Atten=0.0

Right Rear Atten=1.0.

If the source is between the rear left and right speakers 22*c*, 22*d* in sector 3*b* (i.e., 2* π—rear speaker angle >φ≧ rear speaker angle) then:

$\Omega_4$=0.5 π* (φ—rear speaker angle)/(2 π—2* rear speaker angle); and

Left Rear Atten=Sin $\Omega_4$

Right Rear Atten=cos $Q_4$.

If the source is between front left speaker 22*a* and rear left speaker 22*c* in sector 4*b* (i.e., 2π—rear pan start angle >φ≧2π—rear speaker angle):

Left Rear Atten=1.0

Right Rear Atten=0.0.

The Left and Right Rear gains are then calculated to transition between elevation angles θ=0 and ±90 degrees:

Left Rear Gain=Left Rear Atten Gain* $(1—\text{Abs}(\theta/(\pi/2))^{1.5}+0.5*(\text{Abs}(\theta/(\pi/2))^{1.5})$ Right Rear Gain=Right Rear Atten* $(1—\text{Abs}(\theta/(\pi/2))^{1.5}+0.5*(\text{Abs}(\theta/(\pi/2))^{1.5})$ The Left Rear Gain and Right Rear Gain are applied at the filters 42, 55. The rear signals are then further modified by the Rear Gain at the mixer/scalers 44, 54 to produce equal perceived energy contributions from all the speakers while maintaining the same ratio of left to right rear volume.

It is to be understood that the above equations and plot shown in FIG. 7 are provided as an example of a method for calculating gains for the speakers based on position of the sound source.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An audio rendering system comprising:

a front signal modifier configured to receive a plurality of audio signals representing a plurality of sources of aural information and location information representing apparent locations for the sources of said aural information, and apply a gain to the signals representative of the location information, the front signal modifier including a plurality of head-related transfer function filters;

a rear signal modifier configured to receive the plurality of audio signals representing a plurality of sources of aural information and location information representing apparent locations for the sources of said aural information, in the same unmodified form in which they are received at the front signal modifier, and apply a gain to the signals representative of the location information, the rear signal modifier including a plurality of panning filters configured to approximate head-related transfer function filters;

front speakers including a left front speaker and a right front speaker configured to receive signals from the front signal modifier and generate a signal to a listener; and at least one rear speaker configured to receive signals from the rear signal modifier and generate a signal to the listener to offset frontward bias created by the front speakers;

whereby the gains applied to the signal are calculated to produce generally equal perceived energy from each of the front and rear speakers.

2. The audio rendering system of claim 1 wherein the front signal modifier includes a mixer operable to combine the signals to provide a signal to the front left speaker and the front right speaker.

3. The audio rendering system of claim 2 further comprising a cross-talk canceller interposed between the mixer and the front left and right speakers.

4. The audio rendering system of claim 1 wherein the rear signal modifier includes a mixer.

5. The audio rendering system of claim 1 wherein the front and rear signal modifiers each include a cross-talk canceller.

6. The audio rendering system of claim 1 further comprising a second rear speaker.

7. A method for providing a two channel signal to the ears of a listener through an audio system including a plurality of audio signals which are played through two front speakers and at least one rear speaker, comprising:

receiving a plurality of audio signals representing a plurality of sound sources; and generating front input signals by applying a head related transfer function to each signal representative of a location of each of the sound sources;

applying a front gain to the front input signals to create front output signals and sending said front output signals to the two front speakers;

filtering the plurality of audio signals in their original unmodified form using a plurality of panning filters to generate rear input signals that provide left and right panning between the two rear speakers; and applying a rear gain to the rear input signals to create rear output signals and sending said rear output signals to the rear speaker;

whereby the gains applied to the signals are calculated to produce generally equal perceived energy from each of the front and rear speakers.

8. The method of claim 7 further comprising canceling cross-talk in said front speakers.

9. The method of claim 7 further comprising sending the rear signals to two rear speakers.

* * * * *